US006350106B1

(12) United States Patent
Shimizu et al.

(10) Patent No.: US 6,350,106 B1
(45) Date of Patent: Feb. 26, 2002

(54) VARIABLE DISPLACEMENT COMPRESSOR WITH CAPACITY CONTROL MECHANISM

(75) Inventors: Shigemi Shimizu, Gunma; Kiyoshi Miyazawa, Annaka, both of (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/722,333

(22) Filed: Nov. 28, 2000

(30) Foreign Application Priority Data

Dec. 1, 1999 (JP) ..... 11-341913

(51) Int. Cl.[7] ..... F04B 1/26
(52) U.S. Cl. ..... 417/222.2
(58) Field of Search ..... 417/222.2, 222.1, 417/310, 308, 410.5

(56) References Cited

U.S. PATENT DOCUMENTS 5,165,863 A * 11/1992 Taguchi ..... 417/222.2
5,269,661 A * 12/1993 Iizuka et al. ..... 417/310
5,282,725 A * 2/1994 Shimizu ..... 417/222.1
5,332,365 A * 7/1994 Taguchi ..... 417/222.2
5,356,271 A * 10/1994 Miura et al. ..... 417/310
5,362,211 A * 11/1994 Iizuka et al. ..... 417/310
RE35,672 E * 11/1997 Taguchi ..... 417/222.2
5,829,262 A * 11/1998 Urata et al. ..... 62/174
5,885,063 A * 3/1999 Makino ..... 417/310
5,993,171 A * 11/1999 Higashiiyama ..... 417/310
6,050,784 A * 4/2000 Kawada et al. ..... 417/310
6,089,830 A * 7/2000 Harte et al. ..... 417/253
6,142,445 A * 11/2000 Kawaguchi et al. ..... 251/129

FOREIGN PATENT DOCUMENTS

JP 3-13432 2/1991
JP 10-220347 8/1998

* cited by examiner

*Primary Examiner*—Teresa Walberg
*Assistant Examiner*—Vinod D. Patel
(74) *Attorney, Agent, or Firm*—Baker Botts L.L.P.

(57) ABSTRACT

A valuable displacement compressor has several cylinder bores, a crank chamber, a valve plate, a discharge chamber, and a capacity control mechanism for controlling pressure in the crank chamber. A swash plate is disposed in the crank chamber and is tiltably connected to a drive shaft. The swash plate is coupled to each of the pistons, so that the pistons are driven in a reciprocating motion within the cylinder bores. A tilt angle of the swash plate is variable depending on pressure in the crank chamber. A gas passage communicates between the crank chamber and the discharge chamber via the capacity control mechanism, which is disposed along with a line extension of the drive shaft. A first end portion of the capaity control mechanism projects into the discharge chamber and has a screw mechanism.

4 Claims, 2 Drawing Sheets

VARIABLE DISPLACEMENT COMPRESSOR WITH CAPACITY CONTROL MECHANISM

BACKGROUND OF THE INVENTION

1. Field of the Invention

The present invention relates to a refrigerant compressor for use in a vehicular air conditioning system. More particularly, it relates to a variable displacement compressor having an improved capacity control mechanism.

2. Description of Related Art

A known variable displacement compressor is described in Japanese Second (Examined) Patent Publication No. 3-13432. This compressor comprises a cylinder block having a plurality of cylinder bores radially formed therein and arranged about the central axis thereof, and a plurality of pistons slidably received in each of the cylinder bores, respectively. A front housing is securely fixed to a front end surface of the cylinder block to form a crank chamber therebetween, and a drive shaft extends axially through the crank chamber, such that the ends thereof are rotatably supported by the front housing and the cylinder block, respectively, through radial bearings. A conversion mechanism, which comprises shoes, a swash plate, the drive shaft, and the pistons, is provided on the drive shaft within the crank chamber for converting a rotating motion of the drive shaft into a reciprocating movement of the pistons. A hinge mechanism also is provided on the drive shaft within the crank chamber for supporting the swash plate at a variable tilt angle with respect to the central axis against the drive shaft. A cylinder head is fixed securely to a rear end surface of the cylinder block to form a suction chamber and a discharge chamber therebetween, and a valve plate assembly is provided between the cylinder block and the cylinder head. The known compressor has a capacity control mechanism for controlling pressure in the crank chamber. The tilt angle of the swash plate depends on the pressure in the crank chamber. When the tilt angle of the swash plate changes, the stroke or the length of the reciprocating movement of the pistons also changes, and, consequently, the capacity of compressed gas produced by the compressor changes.

The capacity control mechanism of this compressor, which is an outlet control-type mechanism, includes a control valve. The control valve includes a bellows and a needle valve. The bellows is disposed in a communication chamber, which communicates with the crank chamber via a communication passage. When pressure in the crank chamber is greater than the internal vacuum pressure of the bellows due to blow-by gas flowing from the cylinder bores, the needle valve opens the communication passage due to the collapse of the bellows. As a result, refrigerant gas in the crank chamber flows into the suction chamber, and the pressure in the crank chamber decreases. On the other hand, when pressure in the crank chamber is lower than the internal vacuum pressure of the bellows, the needle valve closes the communication passage because the bellows expands. As a result, the pressure in the crank chamber increases due to blow-by gas flowing from the cylinder bores. Thus, the capacity control mechanism controls the pressure in the crank chamber in order to change the tilt angle of the swash plate. As a result, the stroke of pistons is changed, and the volume of compressed gas produced is changed.

Another variable displacement compressor is described in Japanese First (Unexamined) Patent Publication No. 10-220347. This compressor has a capacity control mechanism, which is an inlet control-type mechanism. This compressor has a gas passage, which communicates between a discharge chamber and a crank chamber. The gas passage is controlled by a capacity control mechanism, which is disposed in a cylinder head.

In the outlet control-type, capacity control mechanism of the known compressor, however, when the discharge capacity of refrigerant gas is decreased its quantity by changing a suction pressure control point from low pressure to high pressure, blow-by gas flows into the crank chamber from cylinder bores. Pressure in the crank chamber increases, but is insufficient, because the increase is only due to blow-by gas from the cylinder bores. Therefore, it may be necessary to form another passage to communicate between the discharge chamber and the crank chamber to permit the introduction of refrigerant gas. Further, it may be necessary to form an orifice in this passage. As a result, the structure of this known compressor may be complicated.

In the inlet control-type, capacity control mechanism of the known compressor, however, the capacity control mechanism is disposed in the cylinder head. Therefore, when this known compressor is coupled with an engine of a vehicle, or when this known compressor is fitted with a coupling to an air-conditioning system, the flexibility in the equipment arrangement may be decreased due to the provision of the capacity control mechanism in the cylinder head.

SUMMARY OF THE INVENTION

An object of the present invention is to provide a variable displacement compressor, with the improved capacity response of an inlet control-type, capacity control mechanism.

Another object of the present invention is to provide a variable displacement compressor, which decreases manufacturing costs for the compressor without complicating its structure.

A further object of the present invention is to provide a variable displacement compressor, which increases the flexibility in the arrangement of the coupling for air-conditioning system.

In an embodiment of the present invention, a variable displacement compressor comprises a cylinder block having positioned therein a plurality of cylinder bores, a crank chamber, a valve plate, a suction chamber, and a discharge chamber, and a plurality of pistons, each of which is slidably disposed within one of the cylinder bores. A drive shaft is rotatably supported in the cylinder block. A swash plate is disposed in the crank chamber and is tiltably connected to the drive shaft. A hinge coupling mechanism is mounted on the drive shaft in the crank chamber for supporting the swash plate at a tilt angle with respect to the drive shaft. A coupling mechanism couples the swash plate to each of the pistons, so that the pistons are driven in a reciprocating motion within the cylinder bores upon rotation of the swash plate. A suction and discharge mechanism is connected to the valve plate for drawing refrigerant gas from the suction chamber into the cylinder bores and discharging the refrigerant gas from the cylinder bores to the discharge chamber. A communication passage communicates between the discharge chamber and the crank chamber. A capacity control mechanism is disposed in the communication passage for controlling the tilt angle by regulating a flow of refrigerant gas from the discharge chamber to the crank chamber. The capacity control mechanism is disposed along the a central axis of the compressor that corresponds to a line extension of the drive shaft. A first end portion of the capacity control mechanism projects into the discharge chamber. The first end portion of the capacity control mechanism has a screw mechanism for fixing the suction and discharge mechanism to the valve plate.

Other objects, features, and advantages will be apparent to persons of ordinary skill in the art from the following description of the invention with reference to the accompanying drawings.

BRIEF DESCRIPTION OF THE DRAWINGS

The present invention may be more readily understood with reference to the following drawings, in which.

DETAILED DESCRIPTION OF PREFERRED EMBODIMENTS

Figure 1:
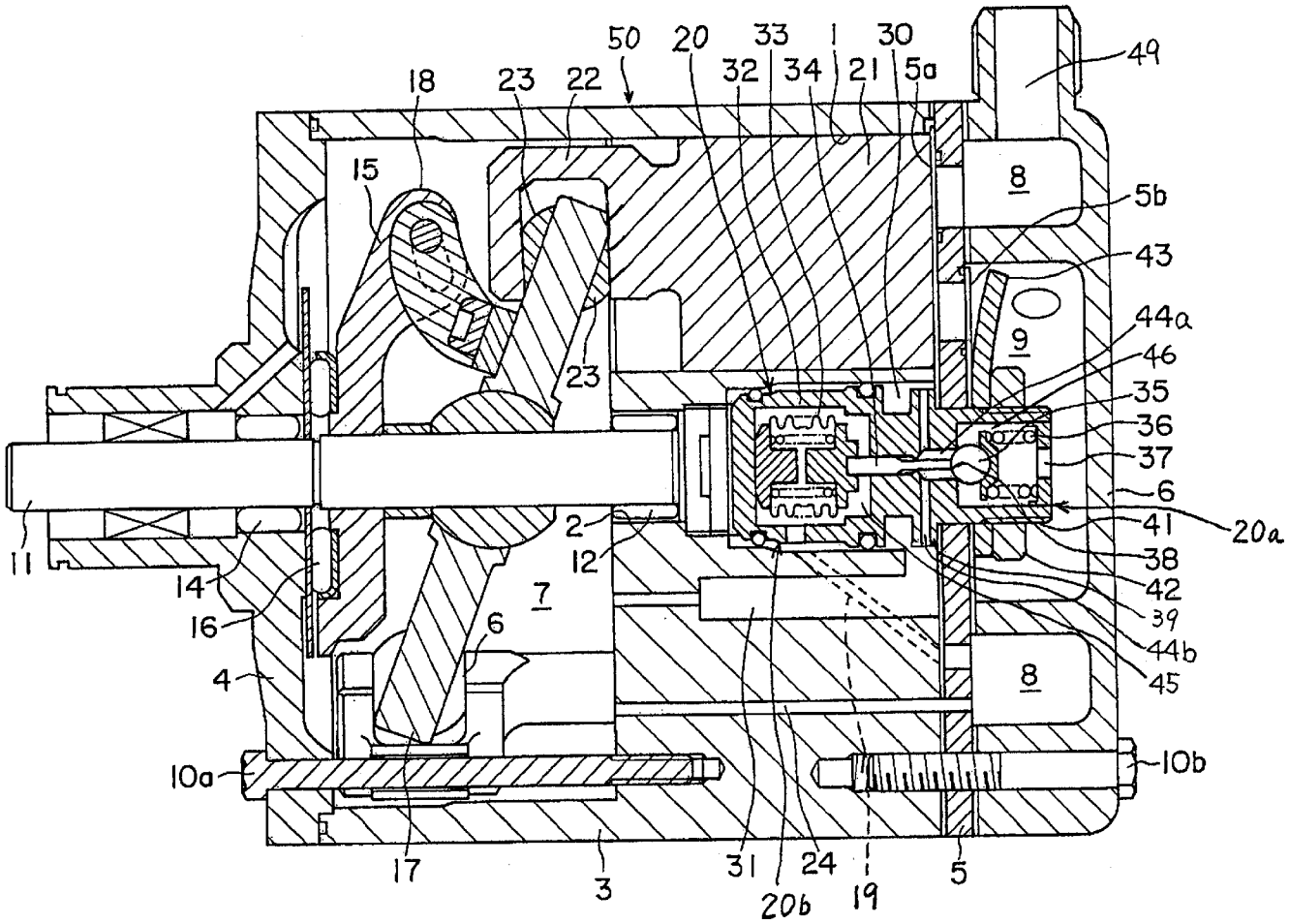
FIG. 1 is a longitudinal, cross-sectional view of a variable displacement compressor, according to a first embodiment of the present invention.

Referring to FIG. 1, a longitudinal, cross-sectional view of a variable displacement compressor, according to a first embodiment of the invention is shown. The shell of compressor 50 comprises front housing 4, cylinder block 3, valve plate 5, and cylinder head 6. These parts are fixed together by a plurality of bolts 10*a* and bolts 10*b*. A plurality of cylinder bores 1 are radially formed in cylinder block 3 and are arranged with respect to the central axis of cylinder block 3. Central bore 2 is formed about the central axis of cylinder block 3. Crank chamber 7 is formed between front housing 4 and cylinder block 3. Suction chamber 8 and discharge chamber 9 are formed in cylinder head 6 and are adjacent to valve plate 5. Each of cylinder bores 1 communicates with suction chamber 8 and discharge chamber 9 through suction flapper valve 5a and discharge flapper valve 5*b*. Drive shaft 11 extends along a central axis of compressor 50 and through crank chamber 7. A portion of drive shaft 11 is rotatably supported by front housing 4 through radial bearing 14. Another portion of drive shaft 11 also is rotatably supported by cylinder block 3 through radial bearing 12, which is disposed in central bore 2.

Rotor 15 is mounted fixedly on drive shaft 11 in crank chamber 7 and rotates with drive shaft 11. Thrust bearing 16 is disposed between an inside surface of front housing 4 and rotor 15. Rotor 15 is coupled to swash plate 17 via hinge mechanism 18, so that swash plate 17 rotates with drive shaft 11, and the tilt angle of swash plate 17 with respect to drive shaft 11 is changeable.

The tilt angle of swash plate 17 depends on pressure in crank chamber 7 that is controlled by capacity control mechanism 20. Bleeding passage 24 is formed in cylinder block 3 and communicates between crank chamber 7 and suction chamber 8. Pistons 21 are accommodated in cylinder bores 2 and are independently and reciprocally movable therein. Hemispherical shoes 23 are disposed between each sliding surface of swash plate 17 and an inner surface of piston skirt portions 22 of pistons 21, so that pistons 21 may slide along the side surface of swash plate 17. Thus, each piston 21 is coupled to swash plate 17 through shoes 23. This coupling mechanism converts a rotating motion of the drive shaft 11 into a reciprocating movement of pistons 21. When the tilt angle of swash plate 17 changes, the stroke of the reciprocating movement of the pistons 21 also changes, and, consequently, the capacity of the compressor 50 to generate compressed gas of compressor 50 changes.

In operation, when a driving force is transferred from an external driving source (e.g., an engine of a vehicle) via a known belt and pulley arrangement (not shown), drive shaft 11 is rotated. The rotation of drive shaft 11 is transferred to swash plate 17 through hinge coupling mechanism 18, so that, with respect to the rotation of drive shaft 11, the inclined surface of swash plate 17 moves axially to the right and the left. Pistons 21, which are operatively connected to swash plate 17 by means of shoes 23, reciprocate within cylinder bores 1. The tilt angle of swash plate 17 with respect to drive shaft 11 changes its angle according to the pressure in crank chamber 7 that is controlled by capacity control mechanism 20. The capacity of the compressor changes, so that the stroke of pistons 21 changes with respect to the variable of the tilt angle of swash plate 17. As pistons 21 reciprocate, refrigerant gas, which is introduced into suction chamber 8 from fluid inlet port 49, opens suction flapper valve 5a and is drawn into each cylinder bores 1 and is compressed. The compressed refrigerant gas opens discharge flapper valve 5b and is discharged into discharge chamber 7 from each cylinder bore 1 and therefrom into a fluid circuit, for example, a cooling circuit, through a fluid outlet port (not shown).

Capacity control mechanism 20 comprises valve device 20*a* and pressure sensoring device 20*b*. Capacity control mechanism 20 is disposed along the main axis of compressor 50 that corresponds to an extension line of drive shaft 11. Valve device 20*a* projects into discharge chamber 9. Pressure sensoring device 20*b* operates valve device 20*a* according to the pressure in crank chamber 7. Valve device 20*a* includes a ball valve 35, a spring 36, an opening 37, a flapper valve 38, and a second chamber 46.

Pressure sensoring device 20*b* is disposed in valve chamber 30, which has a larger diameter than central bore 2. Pressure sensoring device 20*b* includes a box member 32, a bellows 33, a needle valve 34, a flange portion 39, and a first chamber 45. Flange portion 39 divides box member 32 into first chamber 45 and a second chamber 46. Valve chamber 30 communicates with crank chamber 7 via communication opening 31, which is formed in cylinder block 3. Box member 32 is disposed in valve chamber 30 and forms a seal between an inside surface of valve chamber 30 and an outside surface of box member 32. Bellows 33, which has a predetermined spring bias, is located in first chamber 45. One end of needle valve 34 is connected to the top of bellows 33. Another end of needle valve 34 abuts ball valve 35, which seals the control valve and is located in second chamber 46. Ball valve 35 covers valve seat 38 due to the force, which is generated by gas flowing through opening 37 and by spring 36. Opening 37 is formed through and around the center of an end plate of valve device 20*a*. Flange portion 39 of box member 32 abuts suction flapper valve 5*a*. External threads 41 is formed around valve device 20*a*, which projects into discharge chamber 9. A nut 42, which has internal threads, engages external threads 41 to fix a suction and discharge mechanism to valve service 20*a*, which comprises suction flapper valve 5*a*, discharge flapper valve 5*b*, and a retainer 43, to valve plate 5.

When compressor 50 is operated in a high load condition, high suction pressure within crank chamber 8 urges bellows 33 to seat ball valve 35 in valve seat 38 through gas passage 19, by which the suction pressure of crank chamber 8 is sensed. Therefore, control valve opening 44*a* is closed by ball valve 35, and high pressure compressed gas is not provided from discharge chamber 8 to crank chamber 7. In such a condition, refrigerant gas in crank chamber 7 is drawn into suction chamber 8 through bleed passage 24. Thus, a difference in pressure between crank chamber 7 and cylinder bores 1 through pistons 21 is reduced, and the tilt angle of swash plate 17 with respect to drive shaft 11 may be increased, as shown in FIG. 1. As a result, the stroke of pistons 21 may be increased, and the refrigerant capacity of compressor 50 may be increased.

On the other hand, when compressor 50 is operated in a low load condition, low suction pressure of suction chamber 8 urges bellows 33 to unseat ball valve 35 from valve seat 38. Therefore, control valve opening 44*a* is gradually opened, and high pressure compressed gas is provided from dishcarge chamber 9 to crank chamber 7 through a communication passage, which comprises opening 37, control valve opening 44*a*, control valve opening 44*b*, and communication opening 31. In such a condition, the pressure in crank chamber 7 is increased, and a difference in pressure between crank chamber 7 and cylinder bores 1 through pistons 21 is increased. Depending upon this difference in pressure, the tilt angle of swash plate 17 with respect to drive shaft 11 may be decreased. As a result, the stroke of pistons 21 may be decreased, and the refrigerant capacity of compressor 50 may be decreased.

Figure 2:
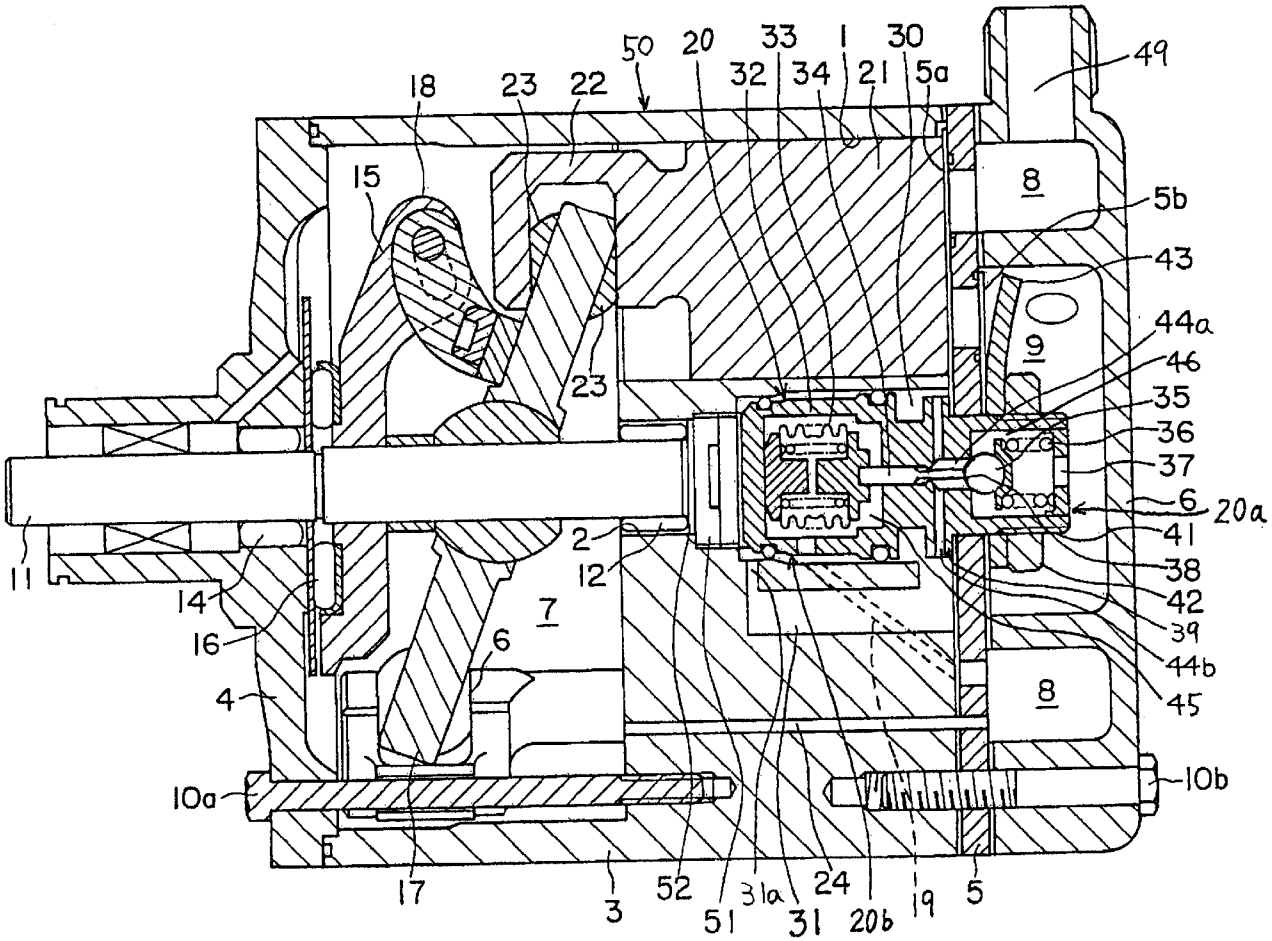
FIG. 2 is a longitudinal, cross-sectional view of a variable displacement compressor, according to a second embodiment of the present invention.

Referring FIG. 2, a longitudinal, cross-sectional view of a variable displacement compressor according to the second embodiment is shown. Because the same numbers are used to represent the same parts of FIG. 1, further explanation of those parts is here omitted.

In compressor 50 of FIG. 2, aperture 31a of communication opening 31 opens to valve chamber 30, and discharged gas is drawn into crank chamber 7 through a gas passage, which comprises control valve opening 44*a*, control valve opening 44*b*, communication opening 31, adjusting screw 51, screw plate 52, and radial bearing 12. As a result, closed condition of radial bearing 12 is prevented, and lubricating oil, which is included in refrigerant gas, lubricates radial bearing 12. Therefore, the durability of radial bearing 12 may be increased.

As described above, in the embodiments of the present invention of a variable displacement compressor, capacity control mechanism 20, which controls the gas passage, is disposed along the central axis of compressor 50 that corresponds to a line extension of drive shaft 11. External threads 41 is formed around valve device 20*a*, which projects into discharge chamber 9. Nut 42, which has internal threads, engages external threads 41 of valve device 20*a* to fix suction flapper valve 5*a*, discharge flapper valve 5*b*, and retainer 43 to valve plate 5. A gas passage through opening 37 and control valve opening 44*a* is formed in the central of valve device 20*a*. Therefore, the machining process of cylinder head 6 that is required in a known variable displacement compressor is no longer required, and the manufacturing cost of compressor 50 may be decreased. Further, because capacity control mechanism 20 is disposed in the central portion of compressor 50, the sealing capacity control mechanism 20, which is required in a known capacity control mechanism, is no longer required. As a result, leakage of refrigerant gas to the compressor exterior from capacity control mechanism 20 may be reduced. Further, the disposition of a capacity control mechanism in a cylinder head is no longer required. As a result, the flexibility in the equipment arrangement with an engine of a vehicle or with a coupling to an air-conditioning system may be increased.

Although the present invention has been described in connection with preferred embodiments, the invention is not limited thereto. It will be understood by those skilled in the art that variations and modifications may be made within the scope and spirit of this invention, as defined by the following claims.

What is claimed is:

1. A compressor comprising:

a compressor housing including a crank chamber, a suction chamber, a discharge chamber, a valve plate, and a cylinder block;

a plurality of cylinder bores positioned in said cylinder block;

a plurality of pistons, each of said pistons slidably disposed within one of said cylinder bores;

a drive shaft rotatably supported in said cylinder block;

a swash plate disposed in said crank chamber and tiltably connected to said drive shaft;

a hinge coupling mechanism mounted on said drive shaft in said crank chamber for supporting said swash plate at a tilt angle with respect to said drive shaft;

a coupling mechanism coupling said swash plate to each of said pistons, so that said pistons are driven in a reciprocating motion within said cylinder bores upon rotation of said swash plate;

a suction and discharge mechanism connected to said valve plate for drawing refrigerant gas from said suction chamber into said cylinder bores and discharging said gas from said cylinder bores to said discharge chamber;

a communication passage for establishing fluid communication between said discharge chamber and said crank chamber; and a capacity control mechanism disposed in said communication passage for controlling said tilt angle by regulating a flow of refrigerant gas from said discharge chamber to said crank chamber;

wherein said capacity control mechanism is disposed along a central axis of said compressor that corresponds to a line extension of said drive shaft, a first end portion of said capacity control mechanism projects into said discharge chamber, said first end portion has a screw mechanism for fixing said suction and discharge mechanism to said valve plate.

2. The compressor of claim 1, wherein said capacity control mechanism includes a valve device and a pressure sensoring device, said valve device projects into said discharge chamber, said pressure sensoring device operates in response to pressure sensed in said crank chamber.

3. The compressor of claim 2, wherein said valve device has a control valve that opens and closes said communication passage, said fluid communication passage communicates between said discharge chamber and said crank chamber via an opening through said valve device that is formed at a center thereof and a passage formed in said cylinder block.

4. The compressor of claim 3, wherein said passage comprises:

an opening formed through said valve device;

a communication opening formed through said cylinder block; and said radial bearing supporting said drive shaft and disposed in a central bore formed along a central axis of said cylinder block.

* * * * *